137-13 SR
11/17/87 OR 4,706,697

United States Patent [19]

Bowen

[11] Patent Number: 4,706,697

[45] Date of Patent: Nov. 17, 1987

[54] REDUCING THE NECESSARY PRESSURE DROP THROUGH SLIDE VALVES

[75] Inventor: Chester O. Bowen, Borger, Tex.

[73] Assignee: Phillips Petroleum Company, Bartlesville, Okla.

[21] Appl. No.: 727,506

[22] Filed: Apr. 26, 1985

[51] Int. Cl.[4] ..... F17D 1/20

[52] U.S. Cl. ..... 137/13; 208/153; 422/110; 422/111; 422/144; 502/41; 406/94

[58] Field of Search ..... 422/144, 145, 110, 111; 502/41; 137/564.5, 13; 208/153; 406/93-95, 192

[56] References Cited

U.S. PATENT DOCUMENTS

| | | | |
|---|---|---|---|
| 1,502,760 | 7/1924 | Barnard . | |
| 2,590,148 | 3/1952 | Berg | 183/4.2 |
| 2,652,175 | 9/1953 | Davis | 222/195 |
| 2,753,061 | 7/1956 | Trainer | 214/152 |
| 2,758,959 | 8/1956 | Nicolai | 502/41 |
| 2,760,911 | 8/1956 | Fritz et al. | 502/41 |
| 2,765,263 | 10/1956 | Fritz et al. | 502/41 |
| 2,781,234 | 2/1957 | Boisture et al. | 422/145 |
| 2,975,919 | 3/1961 | Pappas | 214/152 |
| 3,917,126 | 11/1975 | Beach | 222/195 |
| 4,115,070 | 9/1978 | Vukkola et al. | 422/145 |
| 4,239,155 | 12/1980 | Foa | 239/265.17 |
| 4,290,555 | 9/1981 | Suwa et al. | 239/8 |
| 4,331,533 | 5/1982 | Dean et al. | 208/113 |
| 4,420,279 | 12/1983 | Easley, Jr. | 406/14 |

OTHER PUBLICATIONS

Fluid & Particle Mech., by C. E. Lapple, U of Del, 3/1951, p. 38.

Technology, 1-7-85, O&GJ, pp. 87-92, Ratherman, M. F., Gulf-FCC Catalyst Flow Problem . . .

*Primary Examiner*—Barry S. Richman
*Assistant Examiner*—William R. Johnson
*Attorney, Agent, or Firm*—John R. Casperson

[57] ABSTRACT

Flow control in a standpipe is improved by the introduction of aeration gas into the standpipe immediately above and in a direction of a valve forming the bottom of the standpipe.

15 Claims, 2 Drawing Figures

REDUCING THE NECESSARY PRESSURE DROP THROUGH SLIDE VALVES

BACKGROUND OF THE INVENTION

In one aspect, the invention relates to flow control. In another aspect, the invention relates to flow control in standpipes. In yet another aspect, the invention relates to control of catalyst circulation in a fluid catalytic cracking unit.

Standpipes are used to provide seals between processing units having solids flow therebetween. In the petroleum refining industry, for example standpipes are frequently used to provide a seal between the regenerator and the riser in a fluid catalytic cracking unit. The risk of reaction between oxygen from the regenerator and oil vapor from the bottom of the riser is thus maintained at a low level. In the plastics industry, for example, standpipes are used to prevent commingling between hydrocarbon diluent used in the polymer particle formation process and conveying gas such as nitrogen used in pneumatic polymer conveying systems.

A problem encountered in such systems is that the slide valve typically has little influence over the pressure drop across it. The pressure upstream of the slide valve is largely fixed by the solids particle head. The pressure downstream of the slide valve is largely fixed by the educator pressure downstream of the valve. Thus, the slide valve must operate at a constant pressure drop between two fixed pressures over which the slide valve has little or no control. Usually, a certain minimum pressure drop is desirable in practice for flow stability. The maximum pressure drop is determined by particle throughput requirement and other factors such as wear and erosion on the valve.

When circumstances arise such that the pressure drop available is close to the minimum desirable, such as where the unit has been retrofitted, the unit can be in a very "tight" operating mode, unless there is a means available to increase its operating flexibility. I have discovered such a means.

OBJECTS OF THE INVENTION

It is the first object of this invention to provide a method and apparatus for controlling flow through a standpipe.

It is a further object of this invention to provide a method and apparatus to improve flow control in a standpipe where a slide valve is used.

It is a still further object of this invention to provide an increase in operating flexibility when using a slide valve to control particle flow through a standpipe by reducing the necessary pressure drop through the slide valve.

STATEMENT OF THE INVENTION

In one aspect, the invention can be described as a bin for cotaining a supply for particulate material, a valve beneath the bin for regulating the flow of particulate material from the bin, a conduit which connects the lower end of the bin with the valve, and a means for introducing gas into the conduit into the region just above the valve in a gas flow direction toward the valve. By introducing a small amount of gas through the means for introducing gas, the required pressure drop to achieve a given stable particle flow can be reduced.

In a further aspect of the invention, the pressure drop across a slide valve used to regulate particle flow through a standpoint can be reduced by introducing a gas into the standpipe in a downwardly direction toward the slide valve into the region just above the slide valve. The method of the invention provides a means for increasing the operating flexibility of a unit in which particles are circulated. It has special applicability in situations where the pressure drop is approaching minimum required values for flow stability such as where the unit has been retrofitted upstream or downstream. The invention also has special applicability in reducing the required standpipe head between the bin and the valve.

DETAILED DESCRIPTION OF THE INVENTION

The invention will be described with reference to the fluid catalytic cracking unit shown in FIG. 1 although it will be appreciated that it may be embodied in other devices characterized by a bin for containing a supply of particulate material, one or more valves for controlling the withdrawal of particulate from the bin, a conduit forming a standpipe connecting the bin with the valve means, and a means for introducing gas downwardly into the standpipe into the region just upstream of the valve.

Figure 1:
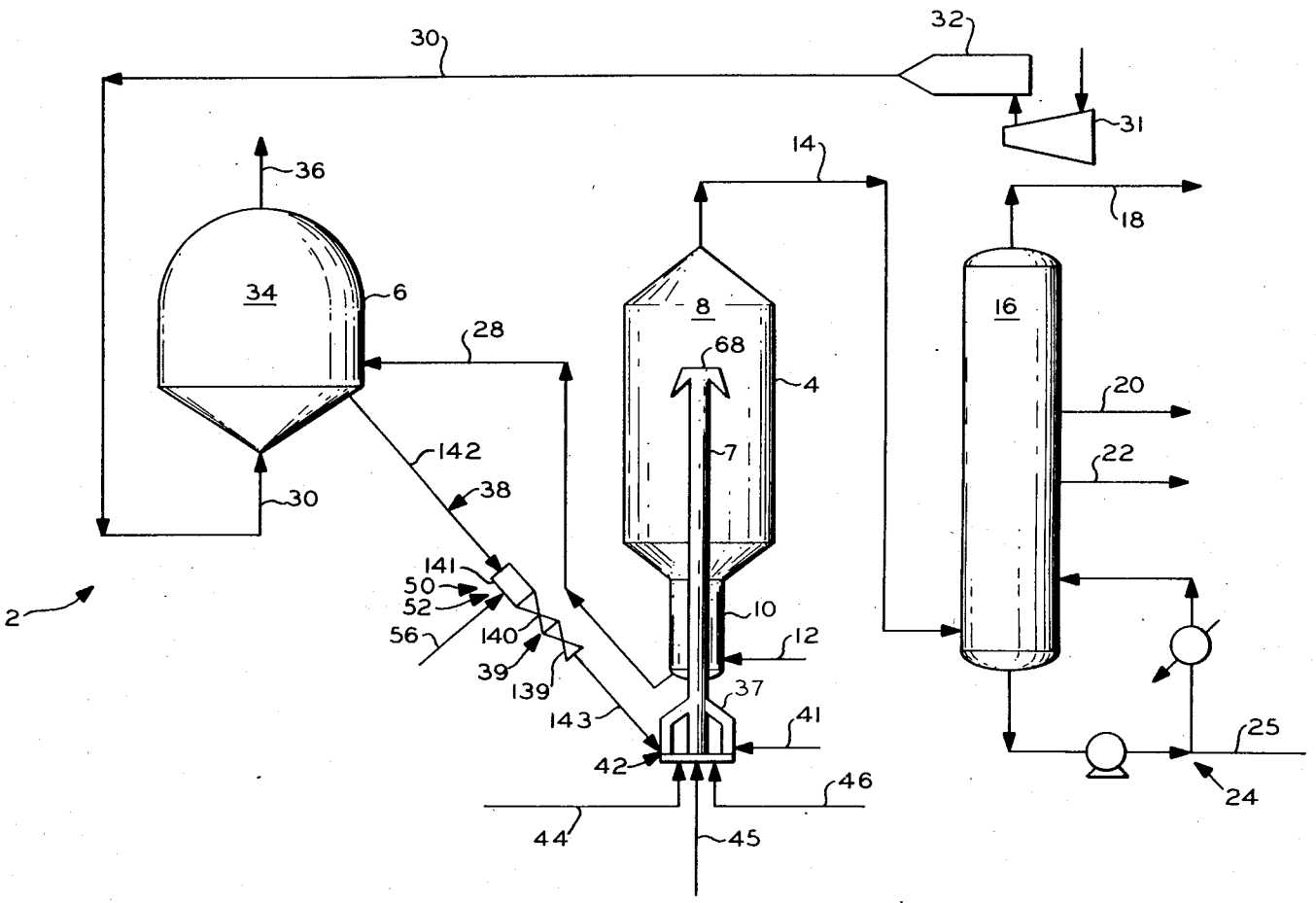
FIG. 1 illustrates one type of catalytic cracking unit in which the present invention can be used.

With reference to FIG. 1, one type of fluid catalytic cracking unit (FCCU) 2 comprises a reactor 4 and a regenerator 6. The reactor 4 comprises a riser reactor or transfer line reactor 7, a catalyst/product separation zone 8 which usually contains several cyclone separators, and a stripping section or zone 10 in which gas, usually steam such as introduced from line 12, strips entrained hydrocarbon from the coked catalyst, although the invention has applicability to various transfer line reactor or conveying systems oriented other than vertically. Overhead product from the separation zone 8 is conveyed via line 14 to a separation zone 16 such as the main fractionator where it is separated, for example, into light hydrocarbons which are withdrawn from the zone 16 by the line 18, gasoline range liquids which are withdrawn by the line 20, distillates which are withdrawn by the line 22, and slurry oils, cycle oils unreacted feed and the like which can be recycled in the quench cooler means 24 as required or withdrawn via line 25.

After being stripped in the zone 10, the cracking catalyst is conveyed from the zone 10 to the regenerator 6 by line 28 for coke burnoff. In the regenerator 6, oxygen containing gas is introduced by a line 30 which is connected to a source of oxygen containing gas such as the air compressor 31 and heater 32. Coke deposits are burned from the catalyst in the regenerator 6 forming an effluent gas which is separated from the catalyst in a separation portion 34 of the regenerator 6 which usually contains a plurality of cyclone separators. These flue gases are withdrawn from the regenerator 6 by the line 36. Hot regenerated catalyst passes from the regenerator 6 to a lift pot 37 at the lower end of the riser reactor 7 by line 38, which provides a source of hot cracking catalyst particles for the riser reactor.

In the lift pot 37, catalyst from the line 38 is fluidized with a fluidizing gas, usually steam, which is introduced into the lift pot 37 by line 41. The oil feedback is introduced into the lift pot 37 via a nozzle cartridge assembly 42 which preferably emits a vapor and fine mist of oil feed axially into the riser or transfer line reactor at the lower end thereof. A line 44 connects the nozzle cartridge assembly 42 with one source of oil feedstock. A line 45 connects the nozzle cartridge assembly with another source of oil such as recycle. Atomizing gas such as steam can be added to the nozzle cartridge assembly 42 by line 46 which connects the nozzle cartridge assembly to a steam source.

The operating conditions for the riser reactor 7 and regenerator 6 can be conventional. Usually, the temperature in the riser reactor 7 will be in the range of from about 850° to about 1050° F. The oil is usually admixed with steam at a weight ratio of oil to steam in the range of from about 6:1 to about 25:1. A catalyst: oil weight ratio employed in the riser reactor 7 is generally in the range of from about 1:1 to about 30:1, usually between about 2:1 and about 15:1. Pressure at a lower end of the riser reactor 7 is usually between about 15 and about 60 psia (pounds per square inch absolute). The cracking catalyst particles generally have a size in the range of from about 20 to about 200 microns, usually between about 40 and 80 microns. Flow velocity upward in the vertical section of the riser reactor is generally from about 10 to 30 feet per second in the lower portions and up to between about 40 and about 120 feet per second in the upper portions. The contact time between the catalyst and oil in the riser reactor is generally in the range of from about 1 to about 4 seconds, usually from 1.5 to about 3 seconds where the oil is injected into the bottom of the riser. The regenerator is operated at a temperature typically in the range of from about 1100° to about 1500° F. and is ordinarily provided with sufficient oxygen containing gas to reduce the coke on the catalyst to a level of about 0.5 weight percent or less, preferably less than 0.1 weight percent.

Catalysts suitable for catalytic cracking includes silica alumina or silica magnesia synthetic microspheres or ground gels and various natural clay-type or synthetic gel-type catalysts. Most preferably, fluidizable zeolite-containing cracking catalysts are employed. Such catalysts can contain from about 2 to about 20 percent based on total weight of zeolitic material, such as Y-zeolite, dispersed in a silica alumina matrix and have an equilibrium B.E.T. sruface area in the range of 25–250 $m^2/g$ and a particle size chiefly in the range of 40 to 80 microns.

The catalyst flow rate through the cracking unit is controlled by a flow control means 50 positioned in the line 38. The flow control means 50 comprises a valve means 39 and a means 52 for introducing gas into the line 38 just above the valve means 39. Preferably, the valve means 39 is positioned in a vertical or near vertical portion of the line 38. Where the regenerator 6 serves as the bin for containing the particulate material the valve means 39 will be positioned beneath the bin and a conduit 142 having an upper end connected to the bin and a lower end connected to the flow control means 50 will serve as the standpipe.

In a preferred embodiment of the invention, the bin for the particulate material is in a portion of the regenerator for a catalytic cracking unit. In such instance, valve means 39 will be connected to a transfer line such as the lower end of the riser reactor 7 by a second conduit 143 and the riser reactor will be in flow communication with the regenerator 6 by a suitable conduit means such as the line 28 to provide for catalyst circulation in a loop between the riser and the regenerator.

Figure 2:
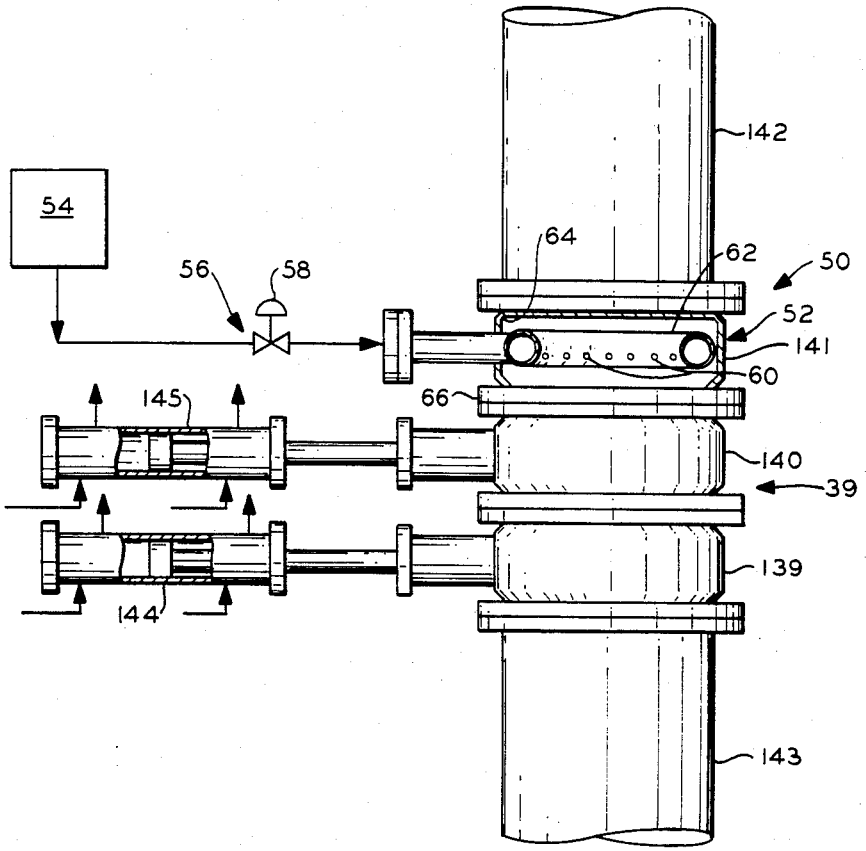
FIG. 2 illustrates in greater detail a portion of the apparatus of FIG. 1 showing additional details.

In a preferred embodiment of the invention, the valve means 39 is formed from at least one valve of the slide valve type. In FIG. 2, the particulate flow rate is controlled by a pair of slide valves 139 and 140. The valves 139 and 140 are controlled pneumatically by cylinders 144 and 145 respectively. Slide valve construction and control is well known by those skilled in the art and will not be further detailed.

The gas source 54 usually comprises steam. If desired however, other gases can be used such as air, hydrogen, hydrocarbons, or nitrogen. Whichever is selected, the conduit means 56 will connect the source 54 with the means 52 introducing the gas. The flow rate of the gas can be regulated by a valve 58 in a manner dependent upon process requirements, the size of the apertures through which the gas is emitted into the standpipe, and catalyst flow rate as further described hereinbelow.

The gas is emitted into the standpipe in a direction toward the slide valve through one or more outlets 60 oriented in a direction toward the slide valve 140. The outlets 60 will be usually be within two standpipe diameters (measured above the means 50) from the valve 140. Preferably, the one or more outlets 60 are positioned at a distance in the range of from about 0.2 to about 1 standpipe diameters above the valve 140.

In a preferred embodiment of the invention, the means 52 is formed from a hollow sparger ring 62 circumferentially extending around an inside surface of the standpipe 124. For service in an abrasive environment, such as in the catalytic cracking unit illustrated, and in any event to avoid unnecessary pressure drop, it is preferred that the sparge ring 62 be positioned in a generally annularly shaped expanded area 64 of the standpipe 142. In the illustrated embodiment, the annularly shaped enlarged area is formed by a valve housing 66 having the gate and seat removed and replaced by the sparge ring 62 attached therein by any suitable means such as welding. Where sparge ring 62 is used, the outlets 60 extend through the sidewall and connect the inside of the standpipe with the inside of the sparge ring and will be selected in size and number so as to avoid unnecessarily high velocities of gas. Generally, velocity through the apertures will be substantially or less than Mach one although sonic velocities can be used where attrition of the particles is not a problem in a pneumatic polymer conveying system. It is contemplated that from 3 to 50, usually from 6 to 30, apertures 60 in a sparge ring will provide suitable results. The orientation of the apertures 60 with respect to the longitudinal axis of the line 38 will range from parallel thereto, i.e. 0 degrees, to converging thereon at an angle of less than 90°, such as at a 60° angle as measured between the axis of the line 38 and the longitudinal axis of the apertures 60, usually 15° and 45°. The apertures 60 will be oriented toward the valve 140 which as previously mentioned will generally be situated vertically beneath the means 52.

A suitable sparge ring 62 can be formed from 1½ to 2½ -inch schedule 160 pipe for example, formed into a ring having an inside diameter usually between 80 and 110% of the inside diameter of the standpipe 142.

In a further aspect of the invention the pressure drop through a valve used to regulate particulate flow from a standpipe situated thereabove is reduced by introducing a gas into the region of the standpipe immediately above the valve in a downward direction. Preferably, the gas is sparged downwardly into the standpipe just above the slide valve. Where the particulate material to be regulated comprises a fluid catalytic cracking catalyst generally from 0.005 to about 0.5 standard cubic feet per second (SCF/sec) are introduced into the standpipe for each ton per minute at which the cracking catalyst is circulated. Preferably, from about 0.01 to about 0.2 SCF/sec of gas is introduced into the standpipe for each ton per minute that the cracking catalyst is circulated. In such a system, the standpipe pressure immediately above the means 52 will generally be in the range of about 15 to 150 psia (pounds per square inch, absolute), usually in the range of from about 20 to about 60 psia. Gas and particles flow downwardly through the slide valve and prevent hydrocarbons from the bottom of the riser from entering the regenerator.

The invention is further illustrated by the following table which is applicable to the device illustrated in the drawings.

TABLE

| Slide Valve % Open | Catalyst Circulation Rate tons/min. | Pressure above slide valve PSIA | Pressure Beneath Slide valve PSIA | Aeration Gas SCF/sec. | Pressure Drop Across Slide valve PSIA | Increase in "Operating Room" PSI |
|---|---|---|---|---|---|---|
| 50 | 30 | 38.6 | 31.85 | 0 | 6.75 | 0 |
| 53 | 30 | 38.6 | 32.50 | 0 | 6.10 | 0.65 |
| 53 | 30 | 38.6 | 33.55 | 1.4 | 5.05 | 1.05 |

What is claimed is:

1. A method for reducing pressure drop across a slide valve used to regulate flow of solids through a standpipe, said method comprising introducing a gas stream through a multiplicity of openings within an inlet means into the standpipe in a direction toward the slide valve from a position closely adjacent to the slide valve.

2. A method as in claim 1 wherein said gas stream comprises an aeration gas selected from the group consisting of steam, air, hydrogen, hydrocarbons and mixtures thereof is sparged downwardly into the standpipe in the region just above the slide valve.

3. A method as in claim 2 wherein the range of from about 0.005 to about 0.5 scf/sec. of aeration gas is sparged into the standpipe for each ton/min. of solids flow through the slide valve.

4. A method for reducing the pressure drop across a valve comprising introducing a gas stream into a standpipe having a valve therein and a flow of solids there through and characterized by a pressure drop across the valve, such gas stream being sparged into the standpipe in the direction of said valve in a region just upstream of the valve at about 0.05 to about 0.5 scf/sec. for each ton/min. of solids flow through the standpipe, wherein the standpipe pressure in the region just above where the gas stream is introduced is in the range from about 15 to 150 psia.

5. A mehod as in claim 4 wherein the steam is introduced at a rate in the range of from about 0.01 to about 0.2 scf/sec. for each ton/min. of catalyst circulation and the pressure in the standpipe is in the range of from about 20 to about 60 psia in the region just above the slide valve.

6. A process as in claim 5 wherein the steam introduced into the standpipe at a velocity which is substantially less than Mach 1.

7. A process as in claim 5 wherein the steam is introduced into the standpipe at a position less than 1 standpipe diameter above the slide valve.

8. Apparatus comprising a catalyst regenerator, a bin for containing a supply of catalyst, such bin located in a portion of the catalyst regenerator; a valve positioned beneath the pin, such valve being a slider valve; a first conduit connecting the bin with the valve, said first conduit forming a standpipe; a riser reactor; a second conduit which connects the slide valve with a lower end of the riser reactor; a third conduit means connecting an upper end of the riser reactor with the catalyst regenerator to provide for loop flow of catalyst between the riser reactor and the catalyst regenerator; a means positioned in the first conduit between the bin and the slide valve closely adjacent to the valve for introducing a fluid into the first conduit in the direction of the said valve including a hollow sparger ring, a source of steam, and a fourth conduit means which connects the source of steam with the sparger ring, said sparger ring extending circumferentially around an inside surface of the standpipe at a distance within one inside diameter of the standpipe from the slide valve, said sparger ring opening to the interior of the standpipe via a plurality of apertures extending through a side wall of the sparger ring in the direction of the slide valve.

9. Apparatus as in claim 8 wherein said apertures are oriented toward the slide valve.

10. Apparatus as in claim 9 wherein the ring is positioned in a generally annular expanded area in the standpipe.

11. Apparatus as in claim 10 further comprising a means for introducing fluid into a lower end of said riser reactor to induce particulate flow up the riser reactor.

12. Apparatus comprising:

(a) a bin for containing a supply of particulate;

(b) a valve positioned beneath the bin;

(c) a first conduit connecting the bin with the valve, said conduit forming a standpipe;

(d) a hollow sparger ring circumferentially extending around an inside surface of the first conduit between the bin and valve at a position immediately adjacent to the valve, said hollow ring having apertures for introducing a fluid into the first conduit in the direction of the valve to reduce the pressure drop across the valve.

13. Apparatus as in claim 12 wherein the bin is located in a portion of a catalyst regenerator; said apparatus further comprising;

(e) a riser reactor;

(f) a second conduit which connects the valve with a lower end of the riser reactor;

(g) a third conduit means connecting the riser reactor with the catalyst regenerator for loop flow of catalyst between the riser and the regenerator;

14. Apparatus as in claim 13 wherein the valve comprises a slide valve;

said apparatus further comprising a source of steam and a second conduit means connecting the source of steam with the means for introducing fluid into the conduit in a direction toward the slide valve.

15. Apparatus as in claim 14 wherein said sparger means is positioned within a distance of less than one standpipe diameter from the slide valve.

* * * * *